US007726388B2

(12) United States Patent
Toda

(10) Patent No.: US 7,726,388 B2
(45) Date of Patent: Jun. 1, 2010

(54) HEAT EXCHANGER

(75) Inventor: Eiji Toda, Mooka (JP)

(73) Assignee: Komatsu Ltd., Minato-ku, Tokyo (JP)

( * ) Notice: Subject to any disclaimer, the term of this patent is extended or adjusted under 35 U.S.C. 154(b) by 102 days.

(21) Appl. No.: 11/660,629

(22) PCT Filed: Jul. 15, 2005

(86) PCT No.: PCT/JP2005/013120

§ 371 (c)(1),
(2), (4) Date: Feb. 20, 2007

(87) PCT Pub. No.: WO2006/022094

PCT Pub. Date: Mar. 2, 2006

(65) Prior Publication Data

US 2007/0256817 A1 Nov. 8, 2007

(30) Foreign Application Priority Data

Aug. 25, 2004 (JP) ..... 2004-244747

(51) Int. Cl.
*F28F 9/26* (2006.01)

(52) U.S. Cl. ..... 165/145; 165/143

(58) Field of Classification Search ..... 165/143, 165/144, 145, DIG. 430, DIG. 431, DIG. 456, 165/DIG. 457
See application file for complete search history.

(56) References Cited

U.S. PATENT DOCUMENTS 1,387,755 A * 8/1921 Beam ..... 165/76
1,482,320 A * 1/1924 Rosenfeld ..... 165/76
1,514,463 A * 11/1924 Rossi ..... 165/76
2,037,845 A * 4/1936 Young ..... 165/139
4,295,521 A * 10/1981 Sommars ..... 165/69
4,741,392 A * 5/1988 Morse ..... 165/76
5,137,080 A 8/1992 Haasch et al.
5,148,863 A 9/1992 Fouts et al.
5,499,674 A * 3/1996 Bartz et al. ..... 165/76
2004/0194933 A1 * 10/2004 Ikeda ..... 165/144

FOREIGN PATENT DOCUMENTS

JP 05-215475 8/1993
JP 07-017449 1/1995
JP 7503058 3/1995
JP 2000-161874 6/2000

* cited by examiner

*Primary Examiner*—Teresa J Walberg
(74) *Attorney, Agent, or Firm*—Fish & Richardson P.C.

(57) ABSTRACT

A plurality of heat exchange units (12) are placed in a frame (38). Respective heat exchange units (12) are positioned by pin holes (30) formed in fixing plates (21) installed on the heat exchange units (12) and knock pins (29) formed on a pair of bars (22) of the frame (38). The one side tank water inlet/outlet ports (19) and the other side tank water inlet/outlet ports (20) of the heat exchange units (12) are connected to the one side water receiving ports (35) of an upper tank (17) and the other side water receiving ports (36) of a lower tank (18), respectively. The upper tank (17), the heat exchange units (12), and the lower tank (18) are fixed to the frame (38) to form the heat exchanger (11). Thus, the heat exchanger having a specified heat exchange capacity and firmly supportable on a base can be provided.

3 Claims, 7 Drawing Sheets

HEAT EXCHANGER

TECHNICAL FIELD

The invention relates to a heat exchanger that comprises a plurality of heat exchange units.

BACKGROUND ART

Conventionally, a heat exchanger that comprises a plurality of heat exchange units connected together in order to obtain a desired heat exchange capacity has been known as a cooling device installed, for example, in a vehicle. As a heat exchanger in which heat exchange units are disposed in a lateral direction, a radiator apparatus described in, for example, the Patent Document 1 has been proposed. On the other hand, as a heat exchanger in which heat exchange units are disposed in a vertical direction, a heat exchanger described in, for example, the Patent Document 2, has been proposed.

FIG. 7 depicts, as a first conventional example, the radiator apparatus described in the Patent Document 1. As shown in FIG. 7, each of heat exchange units 111 comprises: a pair of opposing tanks 115 and 116; tubes 113 by which the pair of tanks 115 and 116 communicate with each other; and fins 114 formed between the tubes 113.

The heat exchange units 111 are disposed in a lateral direction in the heat exchanger, the tanks 115, 115 are respectively connected each other, and the tanks 116, 116 are respectively connected each other by a pair of hoses 112.

FIG. 8 depicts, as a second conventional example, the heat exchanger described in the Patent Document 2. The heat exchanger shown in FIG. 8 is used for warming a room by causing hot water to flow within the heat exchanger. This heat exchanger comprises a plurality of heat exchange units 121 connected together. Each heat exchange unit 121 comprises: a hollow, polygonal tube 123 through which hot water flows; a series of plates 125 projecting from the polygonal tube 123; and parts forming the external contour of the series of plates 125. The heat exchanger is constructed by connecting and fixing together ends 122 of the adjacent polygonal tubes 123 using an adhesive.

Patent Document 1: Japanese Patent Laid-Open Publication No. 7-17449

Patent Document 2: Japanese Patent Laid-Open Publication No. 2000-161874

DISCLOSURE OF THE INVENTION

Problems to be Solved by the Invention

The above-described related art has the problems described below. Specifically, in the first conventional example, the heat exchange units 111, 111 are connected via the hoses 112. Therefore, in order to install the pair of heat exchange units 111 in a vehicle, the heat exchange units 111, 111 must be separately supported on a vehicle body frame or the like.

Additionally, in terms of the assembly of the radiator apparatus from the pair of heat exchange units 111, the heat exchange units 111, 111 can be easily connected together by the hoses 112 outside a vehicle. However, since the heat exchange units 111, 111 are connected only by the hoses 112, they may be moved separately. This makes it difficult to attach the assembled radiator apparatus to the vehicle body as it is. Even if the radiator apparatus is attached to the vehicle body, the time needed to attach the apparatus may be long.

As in the case of attaching the radiator apparatus to a vehicle body, detaching the radiator apparatus from a vehicle body, with the hoses 112 connected between the heat exchange units 111,111, also requires time and effort. In order to facilitate detachment of the heat exchange units 111, 111 respectively from a vehicle body, if it is tried to detach the hoses 112 within the vehicle body, hands the worker may interfere with other components disposed within the vehicle body. This also makes it difficult to detach the hoses 112.

Moreover, in the case where the radiator apparatus is installed in a vehicle that may be subject to intense vibration, the distance between the heat exchange units 111, 111 may be changed due to vibration, resulting in that the hoses 112 may be detached from the heat exchange units 111. In order to prevent detachment of the hoses 112 from the heat exchange units 111, the hoses 112 to be disposed could be long. However, lengthening the hoses 112 requires greater space to dispose the radiator apparatus including the hoses 112. Additionally, lengthening the hoses 112 may lead to the hoses 112 becoming entangled with each other or interfering with other members.

The heat exchanger taken as the second conventional example is configured such that the ends 122 of the polygonal tubes 123 are connected using an adhesive. Therefore, if one of the polygonal tubes 123 is damaged, for example, the removal of only the damaged polygonal tube 123 is not possible; therefore, all the polygonal tubes 123 must be replaced.

Furthermore, in case the heat exchanger taken as the second conventional example is installed in a vehicle subject to intense vibration, the heat exchanger needs to be firmly fastened so as to be resistant to vibration. However, since the heat exchanger according to the second conventional example is used for hot-water central heating, it incorporates no countermeasures against vibration. Accordingly, the configuration according to the second conventional example makes it difficult to secure the heat exchanger on a surface that may be subject to intense vibrations.

The present invention has been made in view of the above-described problems of the conventional examples. It is therefore an object of the invention to provide a heat exchanger to which a specified heat exchange capacity can be imparted and which can be firmly secured to the base on which the heat exchanger is disposed.

Means of Solving the Problems

To achieve the foregoing objects, a heat exchanger according to a first invention comprising a plurality of heat exchange units connected together is mainly characterized by the configuration described below. Specifically, each of the heat exchange units has a pair of tanks and tubes connecting between the pair of tanks. The heat exchange units are disposed such that their fronts are facing a same direction. In addition, the heat exchanger comprises: a frame fixing the plurality of heat exchange units in parallel; an upper tank connecting each tank of each of the heat exchange units on one end side; and a lower tank connecting each tank of each of the heat exchange units on the other end side.

A second invention based on the first invention is mainly characterized by the configuration of each of connected parts between the upper tank and one of the pair of tanks and each of the connected parts of the lower tank and the other pair of tanks.

A third invention based on the first or second invention is mainly characterized by specifying a configuration for positioning the connecting location of the upper tank and one of the pair of tanks and the connecting location of the lower tank and the other pair of tanks.

A heat exchanger according to a fourth invention comprising a plurality of heat exchange units connected together is mainly characterized by the configuration described below. Namely, each of the heat exchange units has a pair of tanks and tubes connecting between the pair of tanks. Respective tanks of the pairs of tanks of adjacent heat exchange units are connected to each other in series. In respective both ends of the pairs of tanks in a connected state, one end of the tanks is configured to be as an inlet/outlet port for a cooling medium and the other end of the tanks is closed by a closing member.

A fifth invention based on the fourth invention is mainly characterized by the configuration in which a sealing member is interposed between adjacent tanks each other and another sealing member is interposed between the tanks and the closing member.

Effect of the Invention

According to the invention, the plurality of heat exchange units are integrally fixed by a frame such that respective fronts of the plurality of heat exchange units are facing the same direction. Thus, the heat exchanger comprising the plurality of heat exchange units can be handled in the same manner as an integrally formed heat exchanger. Furthermore, the heat exchange capacity of the heat exchanger can be easily altered by adjusting the number of heat exchange units disposed.

The frame fixing the plurality of heat exchange units is fastened in the position in which the heat exchanger is to be disposed or unfastened from the position in which it has been disposed. Thereby, the heat exchanger can be easily attached or detached. Even in a case where the heat exchanger is installed for example in a vehicle that may be subject to intense vibration, the heat exchanger can be attached to a vehicle body or the like via the frame so as to be resistant to vibration. Furthermore, since the plurality of heat exchange units are connected and fixed by the frame, liquid leakage between the heat exchange units can be prevented.

Additionally, each heat exchange unit can be replaced per unit and, therefore, the repairability as the heat exchanger improves. Further, positioning each heat exchange unit in relation to the frame facilitates a connection between the upper tank and the one of the pair of tanks of each heat exchange unit and a connection between the lower tank and the other pair of tanks thereof.

EXPLANATION FOR REFERENCE NUMERALS

11 . . . heat exchanger, 12 . . . heat exchange unit, 13 . . . tube, 14 . . . fin, 15 . . . tank, 16 . . . tank, 17 . . . upper tank, 18 . . . lower tank, 21 . . . fixing plate, 22 . . . bar, 23 . . . bar, 24 . . . side post, 29 . . . knock pin, 30 . . . pin hole, 32 . . . pinhole, 35 . . . one side water receiving port, 36 . . . other side water receiving port, 38 . . . frame, 42 . . . heat exchange unit, 43 . . . tube, 44 . . . fin, 45 . . . tank, 46 . . . tank, 49 . . . flange, 54 . . . closing member, 58 . . . air current

BEST MODE FOR CARRYING OUT THE INVENTION

Hereinafter, the embodiments of the present invention will be explained in detail below with reference to the accompanying drawings. First, a description is given of a heat exchanger according to the first embodiment by taking, as an example, a heat exchanger that cools a coolant water by an air-cooling system. Such a heat exchanger is mounted in vehicles, such as construction machines, and used as a cooling device to cool the coolant water of the engine.

First Embodiment

Figure 1:
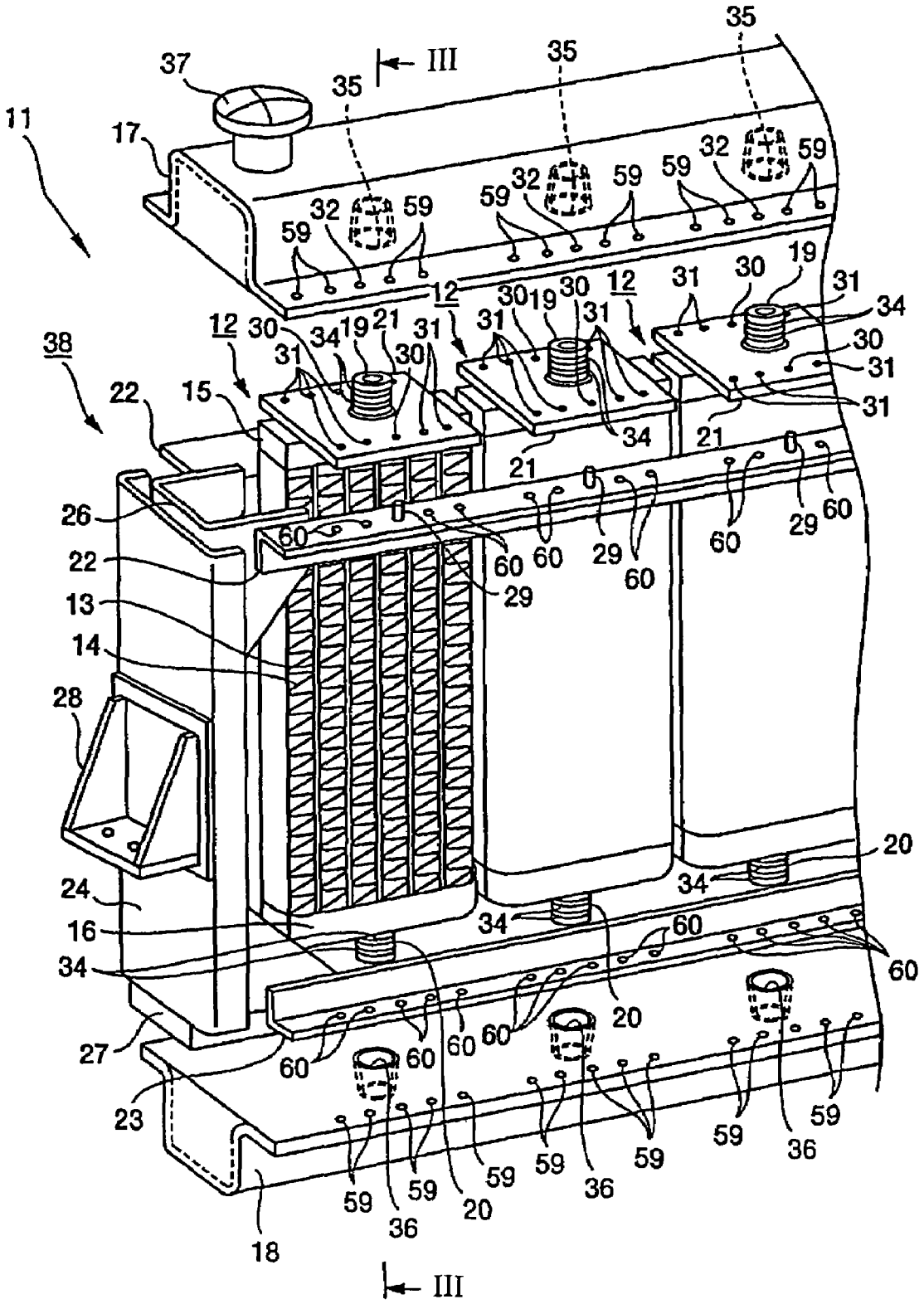
FIG. 1 is a perspective view of a heat exchanger (first embodiment).

FIG. 1 is a perspective view of a heat exchanger 11 according to the first embodiment. As shown in FIG. 1, the heat exchanger 11 is configured by disposing a plurality of heat exchange units 12 side by side such that their fronts are facing the same direction. In the description of the first embodiment, the direction in which the heat exchange units 12 are disposed side by side is referred to as a lateral direction, and the direction perpendicular to the lateral direction in a horizontal plane as the depth direction. In addition, the direction perpendicular to the horizontal direction will be referred to as the vertical direction.

As shown in FIG. 1, the heat exchanger 11 comprises: a plurality of the heat exchange units 12 disposed side by side; an upper tank 17 and a lower tank 18 connecting a pair of tanks 15 and 16, respectively, of each heat exchange unit 12; and a frame 38 that integrally places and fixes each heat exchange unit 12. First, the configuration of the heat exchange units 12 will be explained.

Figure 2:
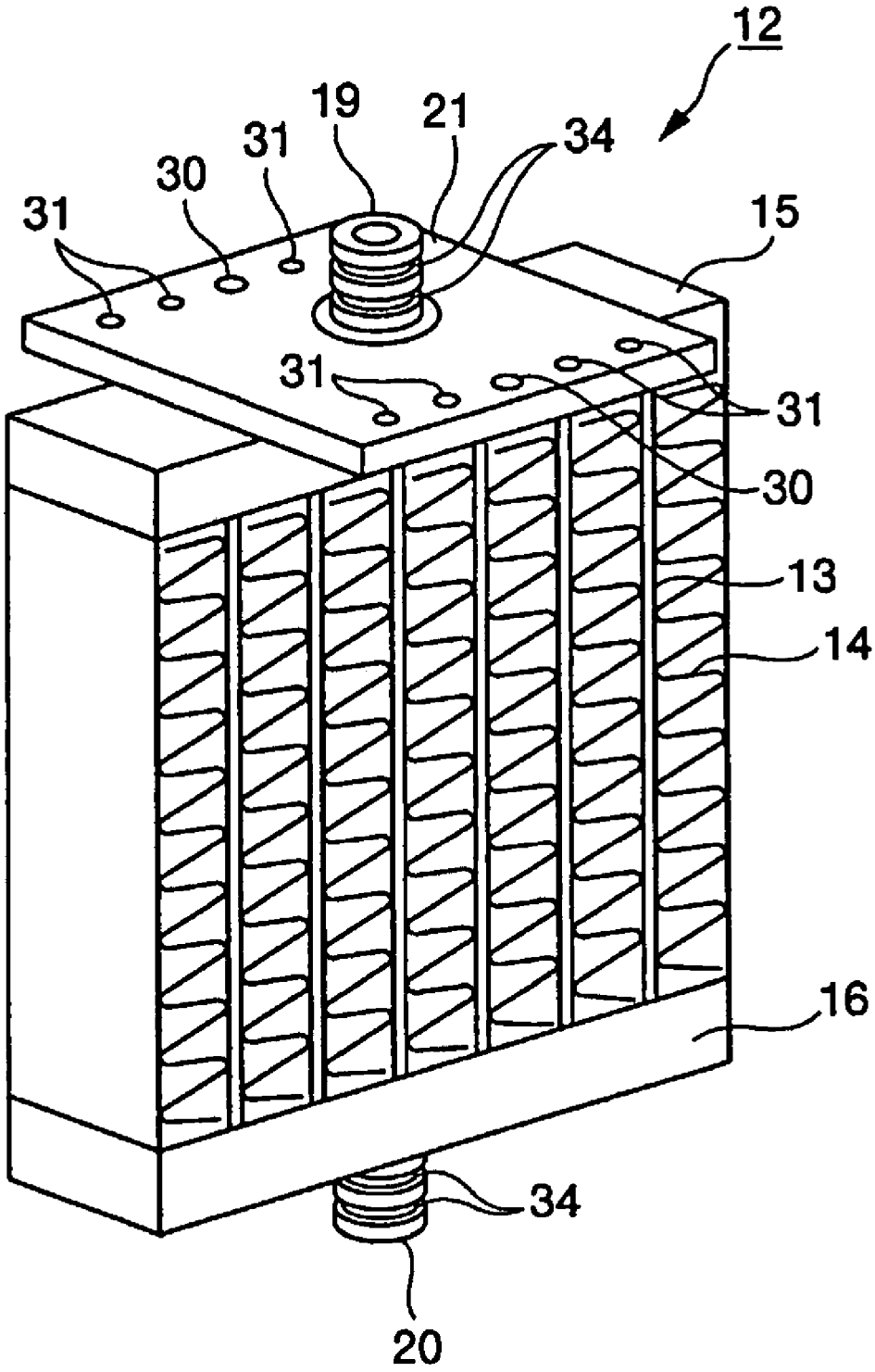
FIG. 2 is a perspective view of a heat exchange unit (first embodiment).

FIG. 2 is a perspective view of one of the heat exchange units 12. The heat exchange units 12 are identical in configuration as that shown in FIG. 2. As shown in FIG. 2, each heat exchange unit 12 comprises a pair of opposing tanks 15 and 16 disposed above and below. The pair of tanks 15 and 16 are connected by a plurality of tubes 13. Also, fins 14 are disposed between the tubes 13.

A tank water inlet/outlet port 19 is formed on the upper side of the tank 15, and a tank water inlet/outlet port 20 is formed on the underside of the lower tank 16, respectively. O-ring grooves 34 are formed around each of the tank water inlet/outlet ports 19 and 20. An O-ring, not shown, can be fitted in each O-ring groove 34.

A fixing plate 21 for fixing the heat exchange unit 12 to a frame 38 (described below) is firmly secured to the upper face of the tank 15 disposed on the upper side of the heat exchange unit 12. The fixing plate 21 and the tank 15 are firmly fixed by joining means such as welding or brazing. A plurality of bolt holes 31 for fixing the fixing plate 21 to the frame 38 (refer to FIG. 1) and a pin hole 30 for positioning the fixing plate 21 to the frame 38 are made in both edge portions of the fixing plate 21 in the depth direction.

The drawings exemplify the case where the number of positioning pin holes 30 made in each edge portion is one.

However, the number of positioning pin holes 30 is not limited to one and may be more than one. Additionally, instead of disposing the heat exchange units 12 of identical size side by side in the lateral direction as shown in FIG. 1, heat exchange units 12 of different lateral dimensions may be disposed side by side.

The heat exchange unit 12 shown in FIG. 1 exemplifies the case where the number of the fins 14 arranged in a lateral direction is six, and the heat exchange unit 12 shown in FIG. 2, seven. In this way, increasing or decreasing the number of the fins 14 arranged in a lateral direction makes it possible to change the dimension of each heat exchange unit 12, namely the lateral dimension thereof.

Referring to FIG. 1, the configuration of the frame 38 will now be explained. The frame 38 is formed from an approximately quadrangular member that comprises a pair of side posts 24, ribs 26 and 27, and a pair of bars 22 and 23. A pair of side posts 24 (the other one is not shown) are disposed on both sides of the frame 38.

A bracket 28 for fastening the heat exchanger 11 to a base is mounted on the external side of each side post 24. The side post 24 and the bracket 28 are firmly fixed by joining means such as welding or bolts. A one side rib 26 and an other side rib 27 are firmly fixed to the upper and lower ends, respectively, of each side post 24 by joining means such as welding.

A pair of L-shaped cross-sectional bars 22, 22 are firmly fixed to the one side ribs 26 by welding or the like so as to extend laterally along their length between the ribs 26 firmly fixed between the opposing side posts 24. Likewise, a pair of L-shaped cross-sectional bars 23, 23 are firmly fixed to the other side ribs 27 by welding or the like so as to extend laterally along their length between the ribs 27 firmly fixed between the opposing side posts 24. Projecting knock pins 29 for positioning are formed so as to project from the upper face of each of the pair of bars 22. Each knock pin 29 can fit into the pin hole 30 for positioning of the fixing plate 21 of the heat exchange unit 12 and the pin hole 32 for positioning of the upper tank 17 in this order.

A plurality of bolt holes 60 are made in the pairs of bars 22 and 23. Bolts, not shown, are inserted in bolt holes 59 made in the upper tank 17, the bolt holes 31 made in the fixing plates 21, and the bolt holes 60 made in the pair of bars 22. Then, nuts, not shown, are screwed on the bolts inserted in the bolt holes. Thereby, the upper tank 17 and the heat exchange units 12 can be fixed to the frame 38 so as to be freely detached.

Similarly, bolts, not shown, are inserted in bolt holes 59 made in the lower tank 18 and the bolt holes 60 made in the pair of bars 23. Then, nuts, not shown, are screwed onto the bolts inserted. Thereby, the lower tank 18 can be fixed to the frame 38 so as to be freely detached.

The heat exchange units 12 are fixed to the frame 38 by the fixing plates 21. Accordingly, even in the case where the heat exchanger 11 whose heat exchange units 12 are made of a low-strength material, such as an aluminum, is installed in a vehicle, liquid leakage or the like from the heat exchanger due to vibration of the vehicle is prevented.

Next, the configurations of the upper tank 17 and lower tank 18 will be explained below with reference to FIG. 1. A plurality of one side water receiving ports 35 are formed on the respective faces of the upper tanks 17, the faces being in contact with the heat exchange units 12. Likewise, a plurality of other side water receiving ports 36 are formed on the respective faces of the lower tanks 17, the faces being in contact with the heat exchange units 12. Each one side water receiving port 35 and each other side water receiving port 36 are connected to the tank water inlet/outlet ports 19 and 20 of the heat exchange unit 12, respectively.

The knock pins 29 formed on the pair of bars 22 and the pin holes 30 for positioning made in the fixing plates 21, and the pin holes 32 for positioning made in the upper tank 17 make it possible to position and connect the one side water receiving ports 35 and the other side water receiving port 36 to the tank water inlet/outlet ports 19 and the tank water inlet/outlet ports 20, respectively. Each knock pin 29 is of sufficient length to project beyond the pin hole 30 of the fixing plate 21 and to be inserted through the pin hole 32 of the upper tank 17.

The number of the one side water receiving ports 35 and the number of the other side water receiving ports 36 match the number of the heat exchange units 12 disposed between the upper tank 17 and the lower tank 18. Where the number of the heat exchange units 12 is smaller than the number of the one side water receiving ports 35 and the number of the other side water receiving ports 36, the water receiving ports 35 and 36 that are not connected to the tank water inlet/outlet ports 19 and 20 respectively may be closed by closing members, not shown.

A main water inlet/outlet port 37 is disposed on the face of the upper tank 17, the face being an opposite side to the heat exchange units 12. Likewise, another main water inlet/outlet port 37 is disposed on the face of the lower tank 18, the face being an opposite side to the heat exchange units 12. The main water inlet/outlet port on the lower tank 18 side is not shown.

Thus, the heat exchanger 11 can be configured by arranging the plurality of heat exchange units 12. Accordingly, the heat exchange capacity can be easily adjusted simply by increasing or decreasing the number of the heat exchange units 12. When the number of the heat exchange units 12 is increased or decreased, it can be dealt with by changing the widths (lateral dimensions) of the frame 38, upper tank 17 and lower tank 18. Further, since the plurality of the heat exchange units 12 are connected by the upper tank 17 and the lower tank 18, the necessary area and volume can be made smaller compared to the case where the heat exchange units 12 are connected by pipes.

Next, a description is given of a procedure for assembling the heat exchanger 11. First, the lower tank 18 is attached to the pair of bars 23 shown in the lower part of FIG. 1. The lower tank 18 is attached by positioning the lower tank 18 with use of the bolt holes 60 made in the pair of bars 23 and the bolt holes 59 made in the lower tank 18, and then temporarily fixing the lower tank 18 to the pair of bars 23 by nuts and bolts (not shown). In order to position the lower tank 18 to the pair of bars 23, knock pins and positioning holes into which the knock pins fit may be provided for the lower tank 18 and the pair of bars 23.

The heat exchange units 12 are inserted between the pair of bars 22 and the pair of bars 23 from above in FIG. 1, and placed in the frame 38. At this time, the heat exchange units 12 can be positioned by fitting the knock pins 29 formed on the pair of bars 22 into the pin holes 30 for positioning formed in the fixing plates 21. Also, the lower tank 18 and the pair of bars 23 which are temporarily fixed are fixed firmly.

Temporarily fixing of the lower tank 18 and the pair of bars 23 allows fine adjustment of the mounting position of the lower tank 18 in relation to the pair of bars 23. Thus, the tank water inlet/outlet ports 20 of the heat exchange units 12 positioned between the pair of bars 22 can be easily inserted into and connected to the other side water receiving ports 36 of the lower tank 18.

In addition, O-rings, not shown, fitted in the O-ring grooves 34 of each tank water inlet/outlet port 20 can connect each tank water inlet/outlet port 20 to the other side water receiving ports 36 in a liquid-tight state.

The fixing plates 21 are positioned with respect to the pair of bars 22, so that the intervals between the tank water inlet/outlet ports 19 of the respective heat exchange units 12 are almost equal to the intervals between the one side water receiving ports 35 of the upper tank 17. Accordingly, placing the upper tank 17 over the heat exchange units 12 from above makes it easy to insert the one side tank water inlet/outlet ports 19 of all the heat exchange units 12 into the one side water receiving ports 35 of the upper tank 17.

In this case, the upper tank 17, the heat exchange units 12, and the frame 38 can be positioned by the knock pins 29. Also, the one side tank water inlet/outlet port 19 is connected to the one side water receiving port 35 of the upper tank 17 by the O-rings, not shown, fitted in the O-ring grooves 34 of each one side tank water inlet/outlet port 19 in a liquid-tight state.

In this state, the bolts, not shown, are inserted in the bolt holes 59 of the upper tank, the bolt holes 31 of the fixing plates 21, and the bolt holes 60 of the pair of bars 22. After that, nuts, not shown, are screwed onto the bolts, thereby fixing the upper tank 17, the heat exchange units 12, and the frame 38 integrally.

The O-rings fitted in the ring grooves 34 of each one side tank water inlet/outlet port 19 have the function of connecting the one side tank water inlet/outlet port 19 and the one side water receiving port 35 in a condition to allow relative movement of the one side tank water inlet/outlet port 19 and the one side water receiving port 35, in addition to the function of connecting the connected parts in a liquid-tight state. Likewise, the O-rings fitted in the ring grooves 34 of each tank water inlet/outlet port 20 have the function of connecting the other side tank water inlet/outlet port 20 and the other side water receiving port 36 in a condition to allow relative movement of the other side tank water inlet/outlet port 20 and the other side water receiving port 36, in addition to the function of connecting the connected parts in a liquid-tight state.

Accordingly, even if the heat exchanger 11 expands or contracts due to heating, the difference of amount of expansion or contraction between the upper tank 17, lower tank 18, and each heat exchange unit 12 can be absorbed. This prevents leakage from the connected parts or damage of the connected parts.

Figure 3:
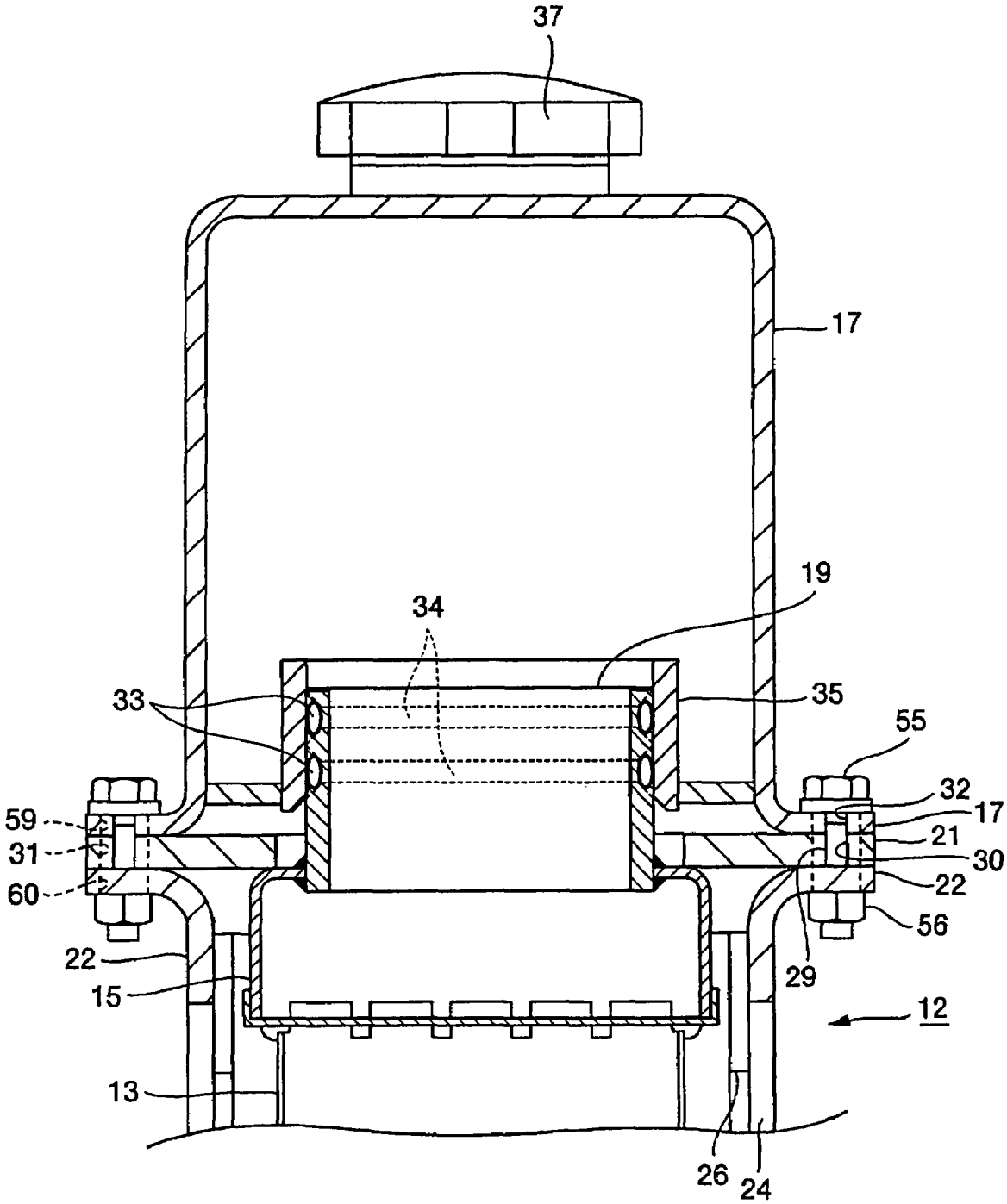
FIG. 3 is a sectional view taken on line III - III of FIG. 1 (first embodiment).

FIG. 3 is a sectional view taken on line III-III of FIG. 1 showing the vicinity of the connected parts of the upper tank 17 and each heat exchange unit 12. In advance, each O-ring 33, 33 is fitted in each of the O-ring grooves 34, 34 formed around the one side tank water inlet/outlet ports 19 of the heat exchange unit 12. Water leakage between the one side water receiving ports 35 and the one side tank water inlet/outlet ports 19 is sealed by the O-rings 33.

Also, each knock pin 29 and the pin holes 30 and 32 dispose the bolt holes 59 formed in the upper tank 17, the bolt holes 31 formed in the fixing plate 21, and the bolt holes 60 formed in the bar 22 so that the center locations of these bolt holes coincide. The use of the bolt holes 59, 31, and 60 enables the upper tank 17, the fixing plate 21, and the bar 22 to be fastened together by bolts 55 and nuts 56. Thus, the heat exchange unit 11 comprising the heat exchange units 12 can be assembled.

In the heat exchanger 11 assembled in this way, the coolant water is supplied from the one side main water inlet/outlet port 37 into the upper tank 17. The coolant water diverged within the upper tank 17 is supplied to the tank 15 of each heat exchange unit 12 from the connected parts of the one side water receiving port 35 and one side tank water inlet/outlet port 19. While flowing through the tubes 13, the coolant water supplied to the tank 15 is cooled by air current passing between the tubes 13 and fins 14 and introduced into the tank 16.

The coolant water introduced into the tank 16 is further introduced to the lower tank 18 from the connected part of the tank water inlet/outlet port 20 and the other side water receiving port 36. The streams of coolant water introduced into the lower tank 18 merge within the lower tank 18, and the coolant water is discharged from a main water inlet/outlet port, not shown, which is formed in the lower tank 18. The coolant water discharged from the main water inlet/outlet port is used to cool an engine, etc.

In the foregoing description of the first embodiment, the upper tank 17 and each fixing plate 21 are fixed to the bars 22 such that the heat exchange unit 12 is hung by the pair of bars 22 via the fixing plate 21. However, the configuration of the heat exchanger 11 is not limited thereto.

For instance, the lower tank 18 disposed at the bottom side, and the fixing plate 21 may be fixed to the pair of bars 23 and the frame 38 may be supported on the fixing plate 21. Alternatively, the axis of coordinate of the vertical and lateral directions of the heat exchanger 11 as shown in FIG. 1 may be reversed.

A sealing structure to seal between the water receiving ports 35 and 36 and the tank water inlet/outlet ports 19 and 20 respectively is exemplified by a structure using the O-rings 33 and the O-ring grooves 34. However, the sealing structure may be formed from another rubber seal such as a D-ring. Also, a connecting structure may be adopted such that flexible tubes or the like are interposed between the connected parts of water receiving ports 35, 36 and the tank water inlet/outlet ports 19, 20 respectively.

In the forgoing, a method for fixing each tank 15 and each fixing plate 21 by welding or brazing was described. However, the tank 15 and the fixing plate 21 may be integrally molded. Additionally, the means for positioning each heat exchange unit 12 is exemplified by the positioning method using the knock pins 29 and the pin holes 30. Another positioning method, which uses, for example, reamer bolts, may also be adopted. As a further alternative, a positioning plate or the like may be fixed to the bars. Thus, any appropriate positioning method may be adopted.

Although the description was given of the pair of L-shaped cross-sectional bars 22 and 23 composing the frame 38, pairs of T-shaped or U-shaped cross-sectional bars 22 and 23 may be used. Furthermore, the above-described procedure for assembling the heat exchanger 11 is not limited thereto, and other assembly procedures can also be adopted.

Further, the pair of bars 23 and the lower tank 18 may be fixed by welding. Also, the method for fixing the pair of bars 22, the fixing plate 21 of each heat exchange unit 12, and the upper tank 17 may include welding.

Second Embodiment

Next, a description is given of the second embodiment of the invention by taking, as an example, a heat exchanger called an 'after-cooler' which cools air by an air-cooling system.

Figure 4:
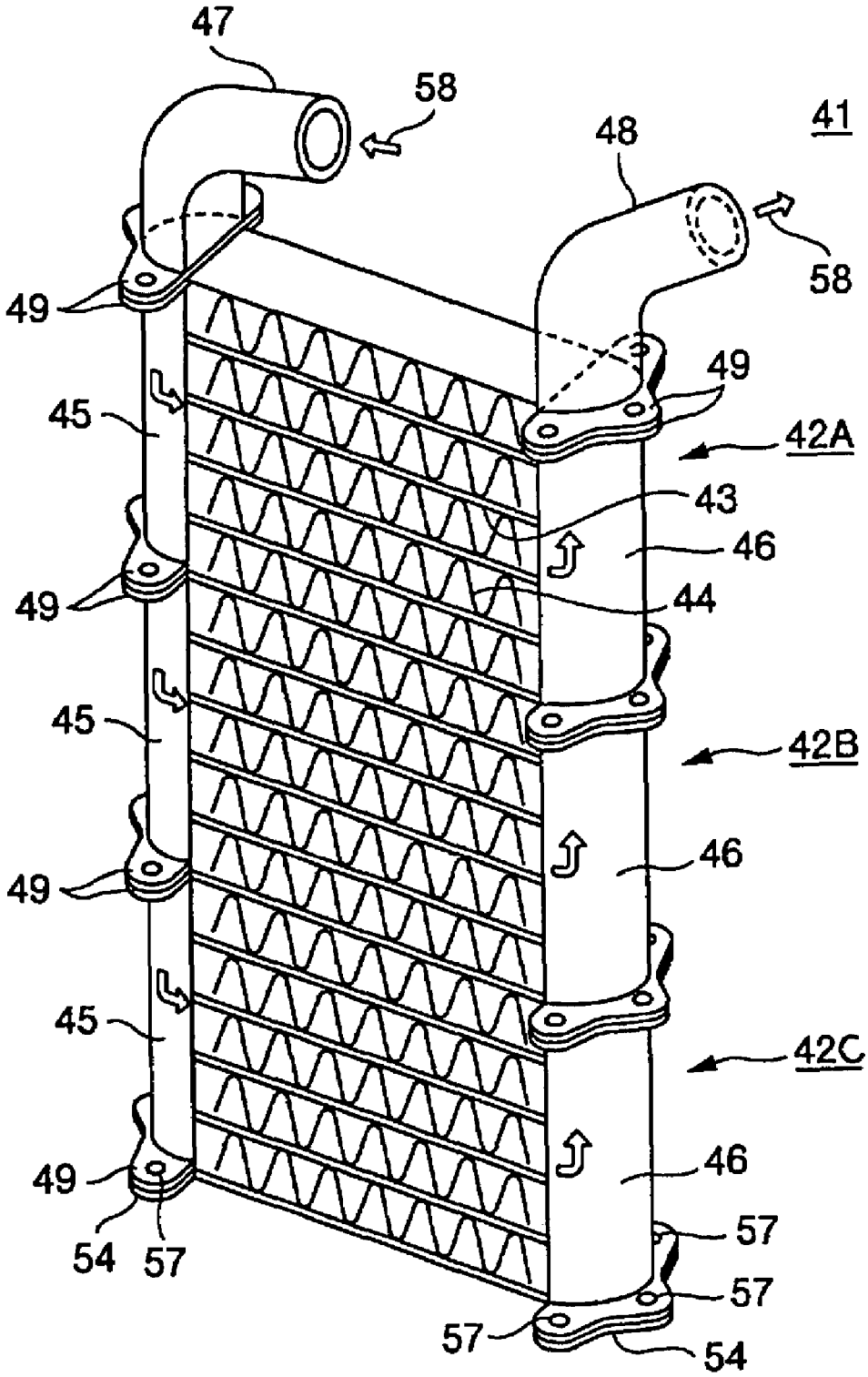
FIG. 4 is a perspective view of a heat exchanger (second embodiment).

FIG. 4 is a perspective view of a heat exchanger 41 according the second embodiment. In FIG. 4, the heat exchanger 41 is configured such that tanks 45 of heat exchange units 42A to 42C adjacent to one another are connected in series and also tanks 46 of the heat exchange units 42A to 42C adjacent to one another are connected in series. In the description of the second embodiment, the vertical direction in which the heat exchange units 42A to 42C are arranged is referred to as an vertical direction, the direction in which the tanks (described below) are opposed as a lateral direction, the direction perpendicular to the lateral direction within a horizontal plane as the depth direction.

As shown in FIG. 4, each of the heat exchange units 42A to 42C comprises a pair of tanks 45 and 46 facing each other in a lateral direction. The pair of tanks 45 and 46 are connected by a plurality of tubes 43. Fins 44 are disposed between the tubes 43.

Figure 5:
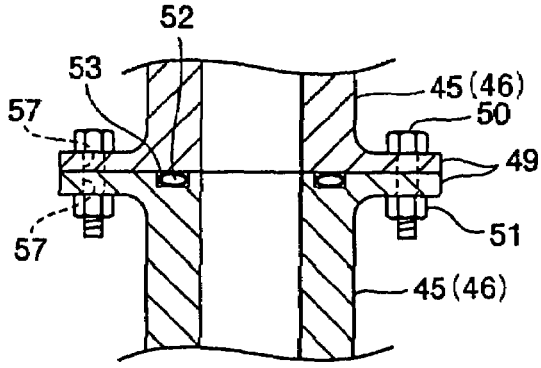
FIG. 5 is a sectional view of the ends of tanks (second embodiment).

In terms of a structure for connecting the respective tanks 45 (or 46) of the heat exchange units 42A to 42C adjacent to one another, FIG. 5 shows a sectional-view of the main part in the vicinity of the end faces of the tanks 45 (or 46). As shown in FIG. 5, a flange 49 having bolt holes 57 is formed at either end of each tank 45 (or 46). Additionally, O-ring grooves 53 are formed in the face of one end of each tank 45 (or 46), and an O-ring 52 is fitted in each O-ring groove 53.

Corresponding bolt holes 57 in the flanges 49 adjacent to each other are aligned, then bolts 50 inserted in the bolt holes 57 and the corresponding nuts 51 are tightened together. In this way, the tanks 45 each other and the tanks 46 each other can be connected respectively so that the inside air is in a condition not to leak out.

Using bolts, not shown, air inlet/outlet members 47 and 48 for allowing air to flow in/out are connected to the upper ends of the pair of tanks 45 and 46, respectively, of the heat exchange unit 42A in FIG. 4, which is situated highest of the connected plural heat exchange units 42A to 42C.

Using bolts, not shown, closing members 54, 54 are fixed to the lower ends of the pair of tanks 45 and 46 of the heat exchange unit 42C in FIG. 4, which is situated lowest of the connected plural heat exchange units 42A to 42C. The closing members 54 close the lower ends of the pair of tanks 45 and 46.

Air discharged from a compressor, not shown, is supplied to the tanks 45 of the heat exchanger 41 from the air inlet/outlet member 47, as indicated by the arrow 58 shown in FIG. 4. Air supplied to the tanks 45 flows into tanks 46 through the tubes 43. Air flowing in the tanks 46 subsequently flows out from the air inlet/outlet member 48 and is supplied to an engine, not shown. While flowing from the tanks 45 to the tanks 46 through the tubes 43, air is cooled by air current passing between the tubes 43 and fins 44.

As explained above, the configuration according the second embodiment is such that the adjacent tanks 45 are directly connected each other and so are the adjacent tanks 46. In the heat exchanger 41 like an after-cooler, in which air as a cooling medium is cooled by the air cooling system, as described in the second embodiment, a liquid as a cooling medium does not flow in the heat exchanger 41. This reduces the weight of the heat exchanger 41. Accordingly, even a configuration in which, without using the frames 38 as described in the first embodiment, the thin tanks 45 each other and thin tanks 46 each other are directly connected respectively, allows the heat exchange units 42A to 42C to be supported.

Incidentally, FIG. 4 shows the configuration in which the three heat exchange units 42A to 42C are connected. However, the number of the heat exchange units connected is not limited to three. Two or more heat exchange units may be connected to compose the heat exchanger.

Although the air inlet/outlet members 47 and 48 are configured to be independent members as shown in FIG. 4, the tanks 45 and 46 of the heat exchange unit 42A that is the uppermost one of the connected heat exchange units can be configured to be integrated with the air inlet/outlet members 47 and 48 respectively. Further, the air inlet/outlet members 47 and 48 can be configured to be screwed into and attached to the tanks 45 and 46 respectively.

The air inlet/outlet members 47 and 48 can be configured to be attached to the heat exchange unit 42A on the same side. However, one of the air inlet/outlet members 47 and 48 can be configured to be attached to the tank 45 or 46 of the heat exchange unit 42A, and the other of the air inlet/outlet members 47 and 48 can be configured to be attached to the tank 45 or 46 of the heat exchange unit 42C.

Figure 6:
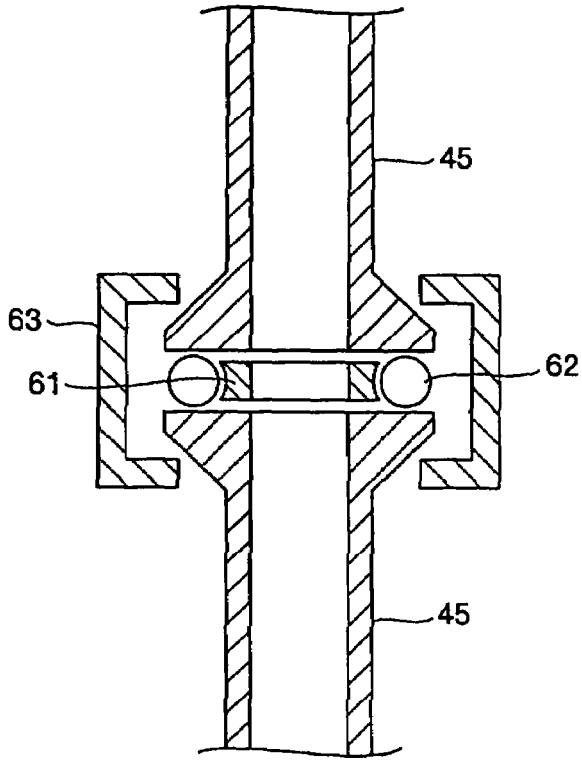
FIG. 6 is a sectional view of the ends of tanks (second embodiment).
Figure 7:
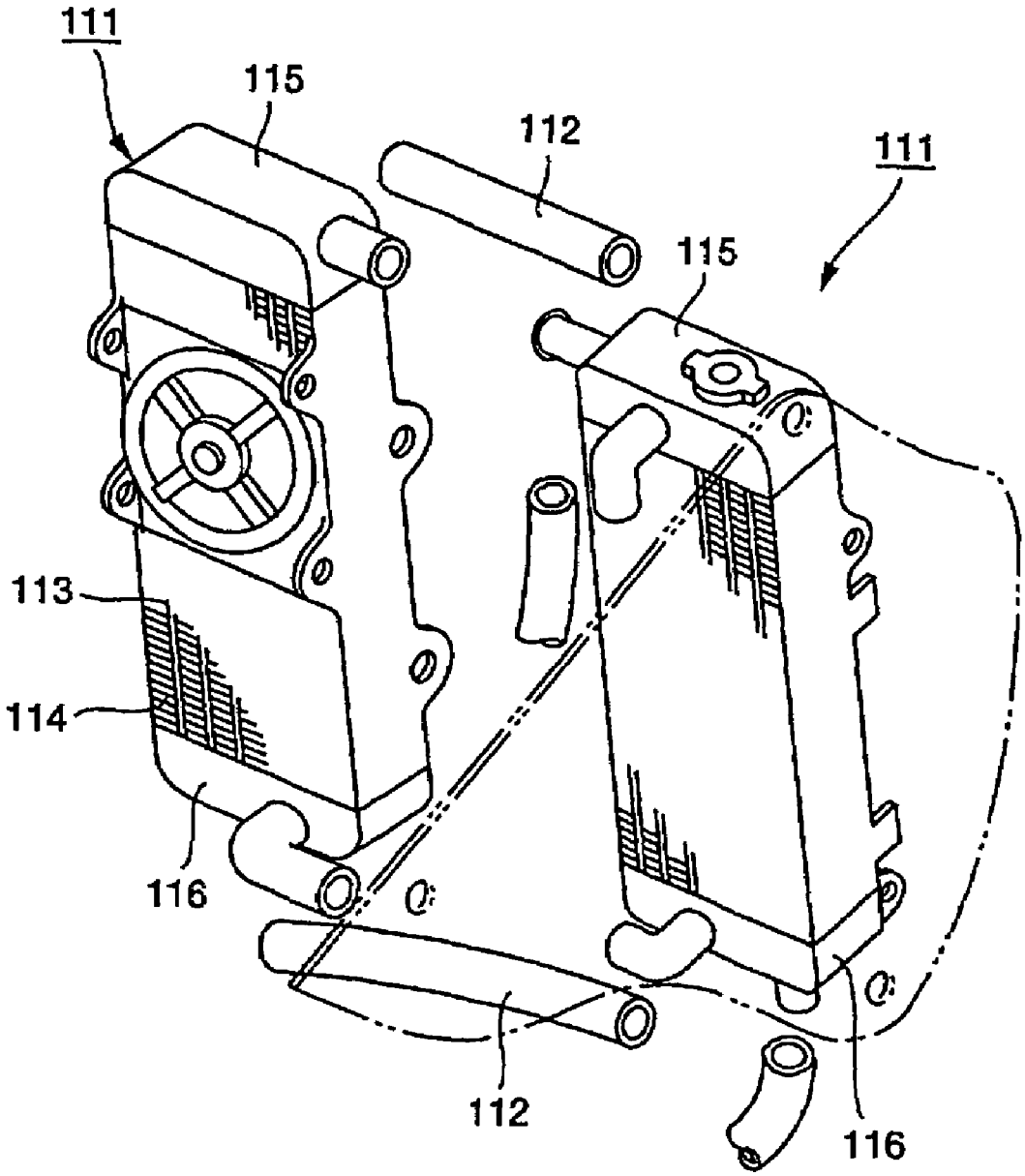
FIG. 7 PRIOR ART
FIG. 7 is a perspective view of a heat exchanger (first conventional example).
Figure 8:
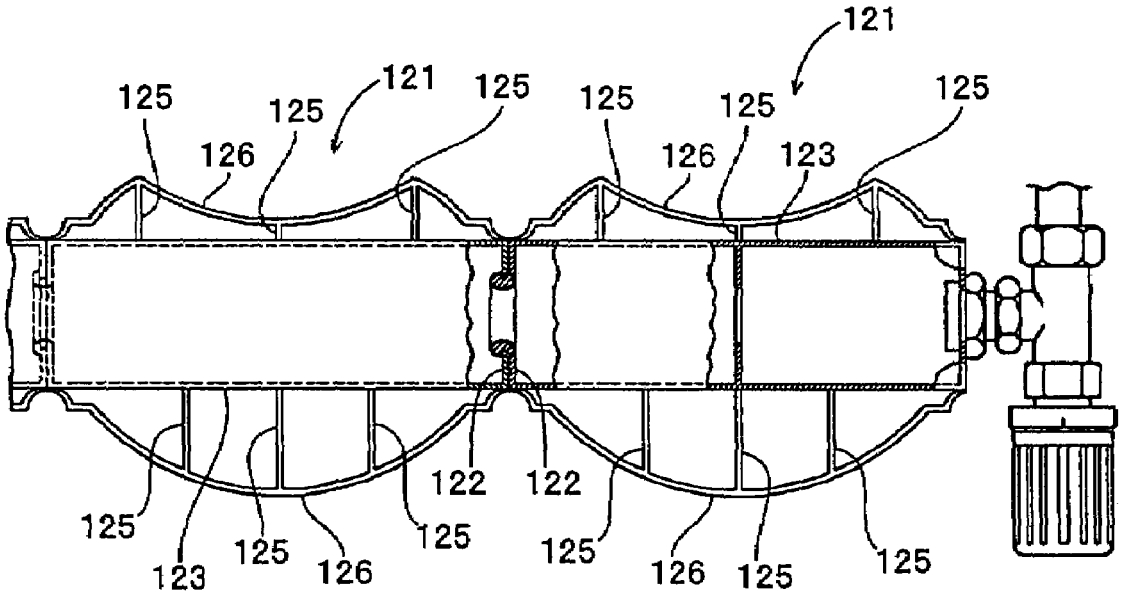
PRIOR ART FIG. 8
FIG. 8 is a perspective view of a heat exchanger (second conventional example).

The sealing structure to prevent air leakage from the connected parts of the adjacent tanks 45 and from the connected parts of the adjacent tanks 46 is exemplified by the configuration using the O-rings 52 and the O-ring grooves 53. The sealing structure, however, may be a configuration using other rubber seals, such as a D-ring, or using a gasket or the like. Further, as shown in FIG. 6, while O-rings 62 with inner liners 61 are sandwiched between the ends of the adjacent tanks 45 and between the ends of the adjacent tanks 46, the ends may be fastened and secured by couplers 63.

Incidentally, the heat exchangers 11 and 41 according to the invention may be made of a material such as iron, copper, aluminum, or resin. Generally, a heat exchanger made of aluminum has the problem that, when aluminum is heated for brazing, it is greatly distorted due to its high coefficient of thermal expansion. This makes it difficult to produce a heat exchanger that has the high heat exchange capacity. According to the invention, adopting the configuration as described above makes it possible to easily produce, even from aluminum, a heat exchanger that has the high heat exchange capacity.

In addition, the invention makes it possible to produce a heat exchanger that is highly resistant to vibration and is compact. Accordingly, this makes it suitable to apply the invention as a heat exchanger for installation in a vehicle. In particular, the heat exchanger according to the invention is appropriate for installation in construction machines that require considerable cooling capacity and must be durable under severe conditions where the machines are subject to intense vibration. However, the invention is not limited to the heat exchangers as described above and may be used as a wide variety of heat exchangers.

INDUSTRIAL APPLICABILITY

The invention can be effectively utilized in apparatus, etc., to which the technique according to the invention can be applied.

The invention claimed is:

1. A heat exchanger comprising a plurality of heat exchange units connected together, wherein:

each of the heat exchange units has a pair of tanks and tubes connecting between the pair of tanks, and the heat exchanger comprises:

a frame fixing the plurality of heat exchange units in parallel such that each front of each of the heat exchange units is facing a same direction;

an upper tank connecting each tank of each of the heat exchange units on one end side; and a lower tank connecting each tank of each of the heat exchange units on the other end side, wherein the frame is configured to comprise a space with a predetermined width inside thereof by a pair of side posts erected with the predetermined width, a first pair of bars disposed on each upper end portion of each of the side posts and disposed on each front side and each rear side of each of the heat exchange units, and a second pair of bars disposed on each lower end portion of each of the side posts and disposed on each front side and each rear side of each of the heat exchange units, the first and second pairs of bars connect and fix between the pair of side posts while sandwiching each of the side posts in a width direction thereof, and wherein the lower tank is attached to the second pair of bars, the plurality of heat exchange units are placed inside the frame from between the space having an approximately quadrangular cross-sectional shape surrounded by the pair of side posts and the first pair of bars, the plurality of heat exchange units are connected to the lower tank, and the plurality of heat exchange units are attached to the first pair of bars disposed on each upper end portion, and the upper tank is connected to each of the heat exchange units so as to cover each upper portion of the plurality of heat exchange units, and is positioned, and the upper tank is attached to the first pair of bars disposed on each upper end portion.

2. The heat exchanger according to claim 1, wherein each of connected parts between the upper tank and the pair of tanks, and between the lower tank and the pair of tanks is connected in a liquid-tight state via a sealing member, and the upper tank and the lower tank and the pair of tanks are allowed their relative movement at each of the connected parts.

3. The heat exchanger according to claim 2, wherein in each of the heat exchange units, a connecting location between at least one of the upper tank and lower tank and the tanks is positioned by the frame.

* * * * *